US007664285B2

(12) United States Patent
Schmidt et al.

(10) Patent No.: US 7,664,285 B2
(45) Date of Patent: Feb. 16, 2010

(54) BOUNDARY LAYER ADAPTER

(75) Inventors: Axel Schmidt, Winsen (DE); Michael Nickel, Wedemark (DE)

(73) Assignee: Sennheiser Electronic GmbH & Co. KG, Wedemark (DE)

( * ) Notice: Subject to any disclaimer, the term of this patent is extended or adjusted under 35 U.S.C. 154(b) by 246 days.

(21) Appl. No.: 10/568,297

(22) PCT Filed: Aug. 7, 2004

(86) PCT No.: PCT/EP2004/008877

§ 371 (c)(1),
(2), (4) Date: Nov. 29, 2006

(87) PCT Pub. No.: WO2005/018274

PCT Pub. Date: Feb. 24, 2005

(65) Prior Publication Data

US 2007/0165877 A1 Jul. 19, 2007

(30) Foreign Application Priority Data

Aug. 14, 2003 (DE) ..... 203 12 610 U

(51) Int. Cl.
*H04R 9/08* (2006.01)

(52) U.S. Cl. ..... 381/361; 381/368

(58) Field of Classification Search ..... 379/430; 181/171, 172; 381/359, 361, 362, 366, 368
See application file for complete search history.

(56) References Cited

U.S. PATENT DOCUMENTS

| | | | | |
|---|---|---|---|---|
| 4,361,736 | A * | 11/1982 | Long et al. | 381/361 |
| 4,396,807 | A | 8/1983 | Brewer | |
| 4,991,220 | A | 2/1991 | Wolf | |
| 5,024,407 | A | 6/1991 | Bartley | |
| 6,226,386 | B1 * | 5/2001 | Akino | 381/361 |
| 6,724,904 | B1 | 4/2004 | Winter | |
| 7,251,340 | B2 * | 7/2007 | Juhler | 381/361 |

FOREIGN PATENT DOCUMENTS

DE 202 07 025 10/2002

* cited by examiner

*Primary Examiner*—Brian Ensey
(74) *Attorney, Agent, or Firm*—Reed Smith LLP

(57) ABSTRACT

There is provided an interface adapter for receiving a microphone, wherein the interface adapter has a receiving unit with a through hole for receiving a microphone and an arresting unit for arresting a received microphone. That permits the microphone to be easily fixed on a boundary surface or interface, such as for example on a table top, a glass plate, tiles, wooden floors, concrete floors and the like. In other words the use of the interface adapter defines an interface which plays an important part in audio recording.

10 Claims, 5 Drawing Sheets

BOUNDARY LAYER ADAPTER

CROSS-REFERENCE TO RELATED APPLICATIONS

This application claims priority of International Application No. PCT/EP2004/008877, filed Aug. 7, 2004 and German Application No. 203 12 610.6, filed Aug. 14, 2003, the complete disclosures of which are hereby incorporated by reference.

BACKGROUND OF THE INVENTION a) Field of the Invention

The present invention relates to a boundary layer adapter for receiving a microphone.

b) Circumstances Relating to the Invention

In the case of directional microphones which are set down for example on a table top in order to be used as a table microphone or as a conference microphone, simply fixing the microphone on the table top is often not readily possible.

OBJECT AND SUMMARY OF THE INVENTION

Therefore the primary object of the invention is to provide a boundary layer or interface adapter which makes it possible for a microphone to be operated readily on a top or plate or a support surface.

That object is attained by an interface adapter for receiving a microphone comprising a receiving unit having a hole for receiving a microphone and at least one arresting unit for arresting a received microphone.

The object is also attained by an interface adapter for receiving a microphone comprising at least one guide element for receiving a microphone, at least one arresting unit for arresting a received microphone and a connecting element for connecting the guide elements.

Therefore there is provided an interface adapter for receiving a microphone, wherein the interface adapter comprises a receiving unit having a through hole for receiving a microphone and an arresting unit for arresting a received microphone.

That permits the microphone to be easily fixed on a boundary surface or interface such as for example on a table top, a glass plate, tiles, wooden floors, concrete floors and the like. In other words the use of the interface adapter defines an interface which plays an important part in audio recording.

In accordance with a configuration of the invention, the interface adapter has a guide unit for guiding a received microphone. The resistance to tipping of the interface adapter is substantially increased by means of the guide unit.

In accordance with a further configuration of the invention the interface adapter has means for solid-conducted sound decoupling.

In accordance with a further configuration of the invention the means for solid-conducted sound decoupling are in the form of rubber rings, thereby improving both the solid-conducted sound decoupling effect and also the resistance to slipping.

In accordance with a further configuration of the invention a buffer is provided in the through hole in the receiving unit. The buffer protects the microphone from damage which can occur when arresting the microphone.

Further configurations are the subject-matter of the appendant claims.

The invention and embodiments by way of example thereof are described in detail hereinafter with reference to the drawings.

DESCRIPTION OF THE PREFERRED EMBODIMENTS

Figure 1:
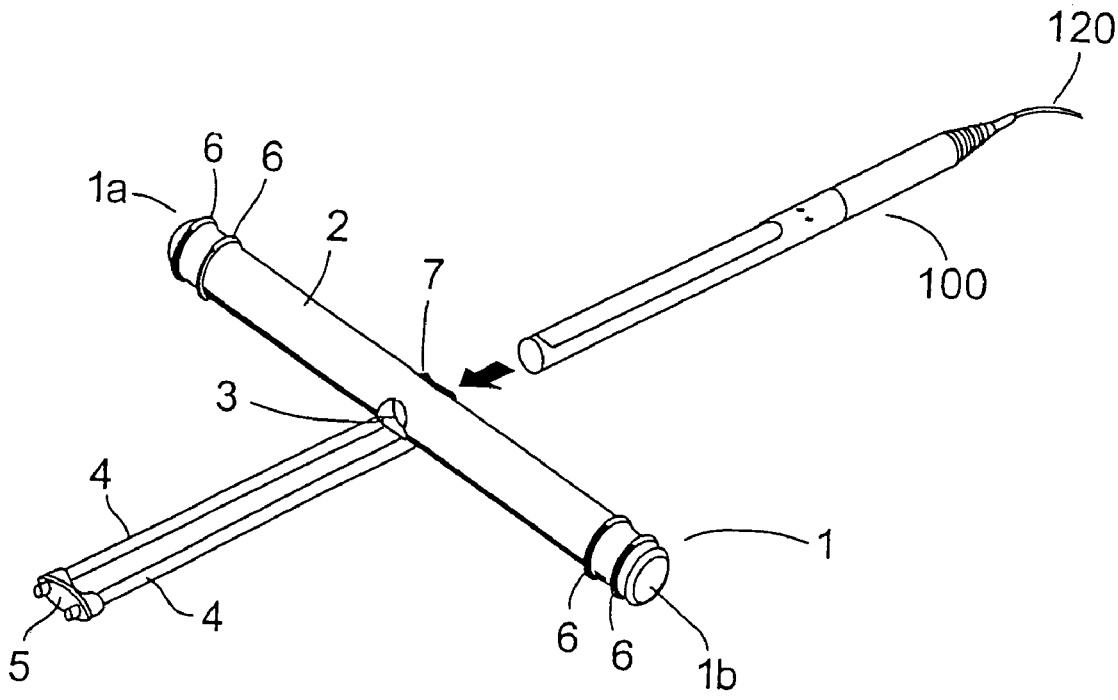
FIG. 1 shows a perspective view of an interface adapter and a microphone to be received thereby in accordance with a first embodiment.

FIG. 1 shows both the interface adapter 1 and also the microphone 100 to be received. The interface adapter substantially comprises a cylindrical main body 2 and a guide element 4. The cylindrical main element 2 has a through hole 3 which is aligned with the guide element in such a way that, when a microphone 100 is passed through the through hole 3, it is received by the guide element 4 on the other side of the main element and guided in the guide element. A preferably resilient microphone abutment 5 is provided at the end of the guide element 4, which is remote from the main element 2. The cylindrical main element 2 has two rubber rings 6 at each of its two ends 1*a*, 1*b*. Provided in the through hole 3 is an elastic guide sleeve 7 of an inside diameter corresponding substantially to the outside diameter of the microphone 100. A screw connection is provided at the first end 1*a* of the main element 2 in such a way that a microphone inserted into the through hole 3 and into the guide sleeve 10 is arrested or clamped fast in position by rotating the first end 1*a* of the main element 2.

Figure 2:
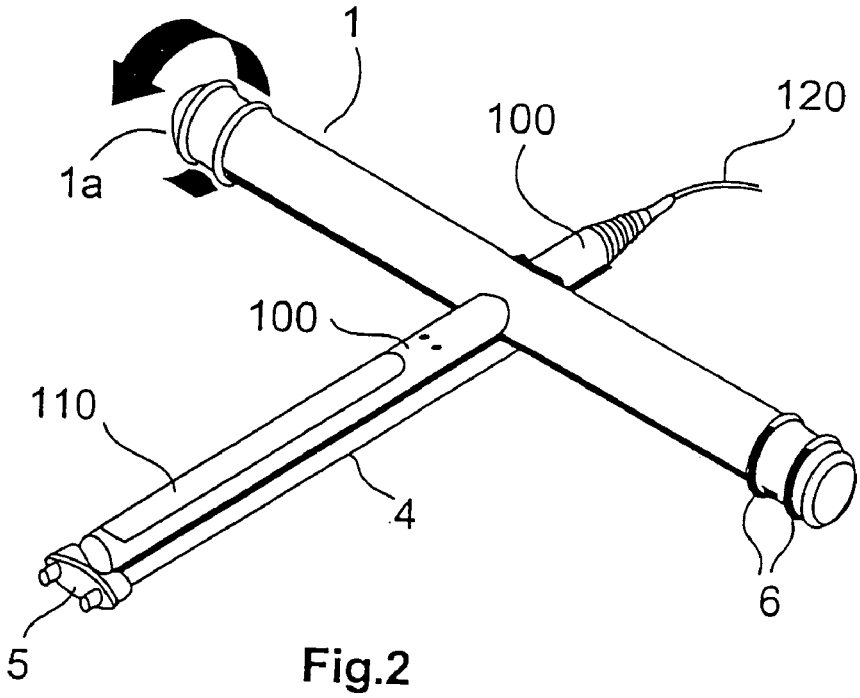
FIG. 2 shows a perspective view of an interface adapter with a microphone received therein.

FIG. 2 shows the interface adapter 1 and the microphone 100 of FIG. 1. In FIG. 2, the microphone 100 has been introduced through the through hole 3 and arrested in position by rotating the first end 1*a* of the main element 2. In this case the microphone is pushed through the through hole 3 to such an extent that it bears with its one end against the microphone abutment 5.

When introducing and arresting the microphone 100, care is to be taken to ensure that the receiving portion 110 of the microphone is not obstructed by the guide elements 4 or the abutment 5.

The T-shaped combination consisting of the cylindrical main element 2 and the guide elements 4 ensures that the microphone 100 when inserted into the interface adapter cannot tilt. As only the O-shaped rubber rings 6 and the elastic microphone abutment 5 come into contact with a boundary layer or interface such as for example a glass plate, a table top, a tile, a wooden floor or a concrete floor, the interface adapter is decoupled from the solid-conducted sound of the interface. As the microphone 100 which is received in the interface adapter in turn comes into contact with the interface adapter only at the microphone abutment 5 and the guide sleeve 7 and as those two elements are each of an elastic nature the microphone is also decoupled from the solid-conducted sound or the structure-borne sound of the interface adapter 1.

Preferably a directional microphone is used as a microphone 100, but other microphones are also suitable for being received in the interface adapter as long as the outside diameter of the microphone substantially corresponds to the inside diameter of the guide sleeve. Apart from the above-described screw connection between the first end 1*a* and the guide sleeve 7, other connections such as for example a clamping means are also possible, for arresting the microphone 100 in the interface adapter.

Introducing the microphone 100 into the interface adapter 1, arresting the microphone 100 and actuating the above-described clamping means provides that a microphone can be securely received in the interface adapter 1 and then oriented and positioned on the interface as desired.

The above-described interface adapter provides for fixing a microphone on an interface such as for example a table top. Solid-conducted sound decoupling is achieved by the provision of the rubber rings 6 and the microphone abutment 5 as well as the elastic guide sleeve 7. The elastic guide sleeve 7 further serves for protecting the microphone in the clamping connection or in regard to the arresting means. The fact that the microphone 100 is only releasably connected to the interface adapter 1 means that the microphone can be used both as an interface microphone and also in other ways when it is removed from the interface adapter.

The rubber rings 6 as well as the provision of a given weight in respect of the base element 2 serve to provide that the interface adapter can be placed in a non-slip fashion on a plate or top.

Figure 3:
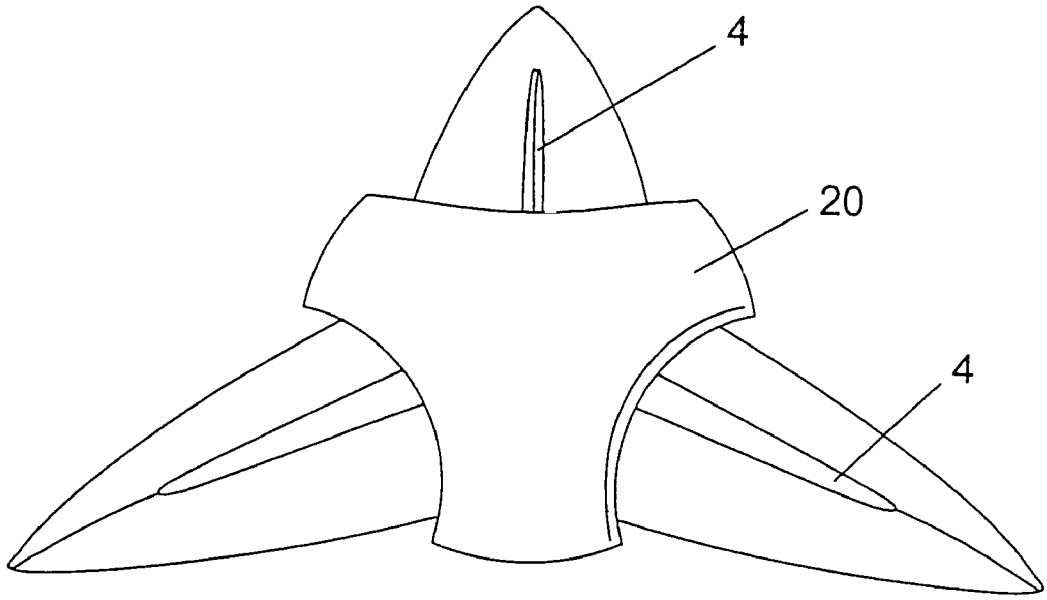
FIG. 3 shows a perspective view of an interface adapter in accordance with a second embodiment.

FIG. 3 shows an interface adapter in accordance with a second embodiment. That adapter has three guide elements 4 each for receiving a respective microphone 100. In contrast to the first embodiment where the guide element 4 is implemented by two bars, the guide element 4 in the second embodiment is implemented substantially by a groove 42. The three guide elements 4 are assembled in a star configuration and a cover element 20 covers that region where the three guide elements 4 meet.

Figure 4:
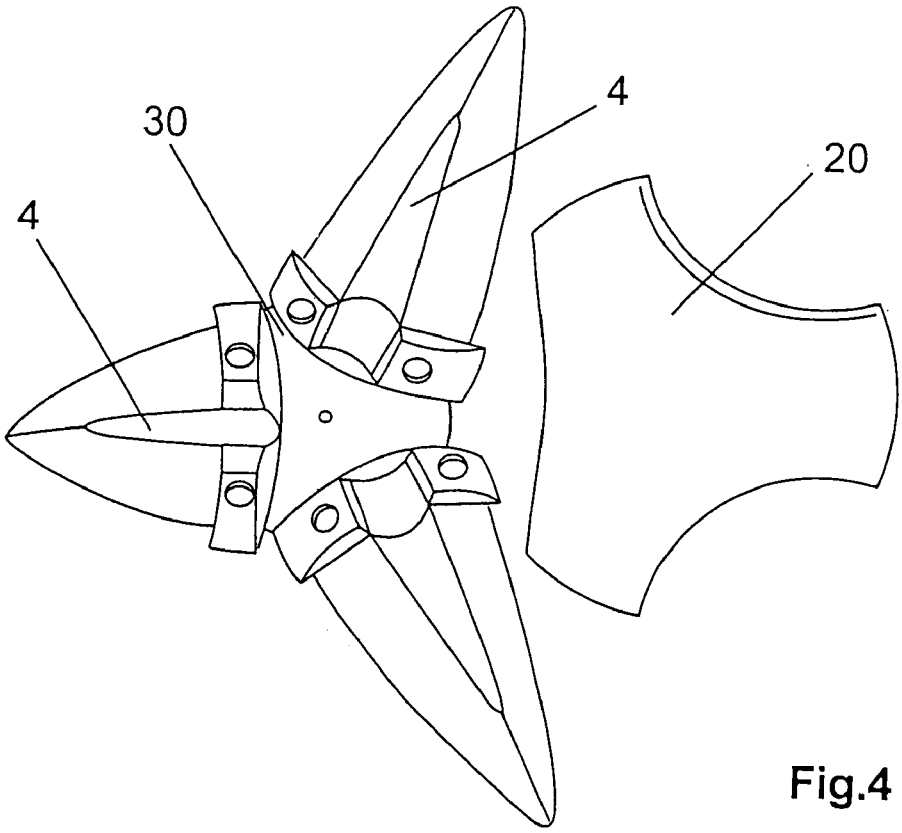
FIG. 4 shows a perspective view of the interface adapter of FIG. 3.

FIG. 4 shows the interface adapter in accordance with the second embodiment, as illustrated in FIG. 3, but in this case the cover element 20 has been removed so that a connecting element 30 which connects the three guide elements together is visible.

Figure 5:
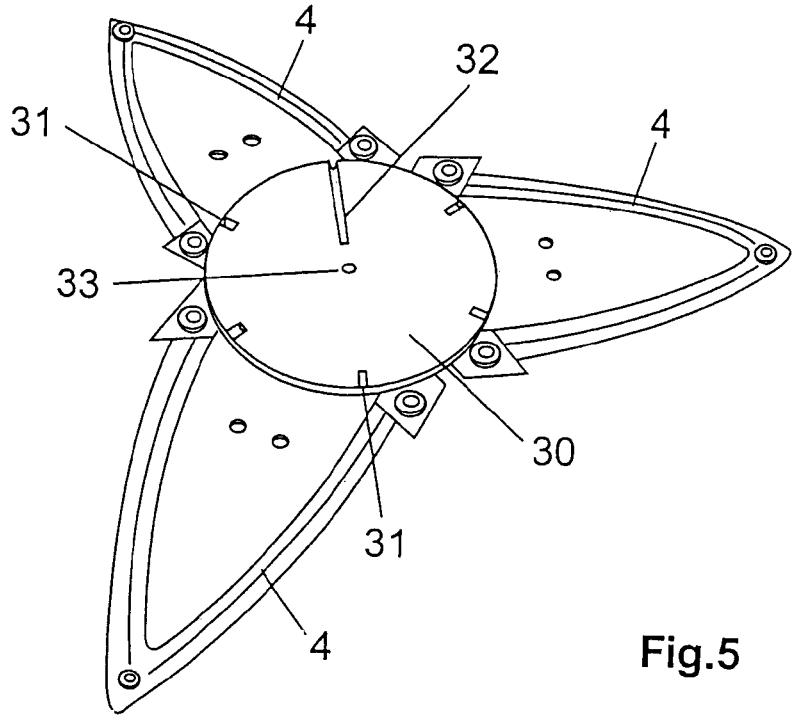
FIG. 5 shows a view of the underside of the interface adapter of FIG. 3.

FIG. 5 shows the underside of the interface microphone of FIG. 3. In this case the connecting element 30 can be clearly seen. This connecting element 30 is of a circular configuration in the second embodiment. It has five recesses 31, a long recess 32 and a hole 33 in the center of the connecting element. The recesses 31 and 32 serve to pass through the microphone cables of those microphones which are mounted in the guide elements 4.

Figure 6:
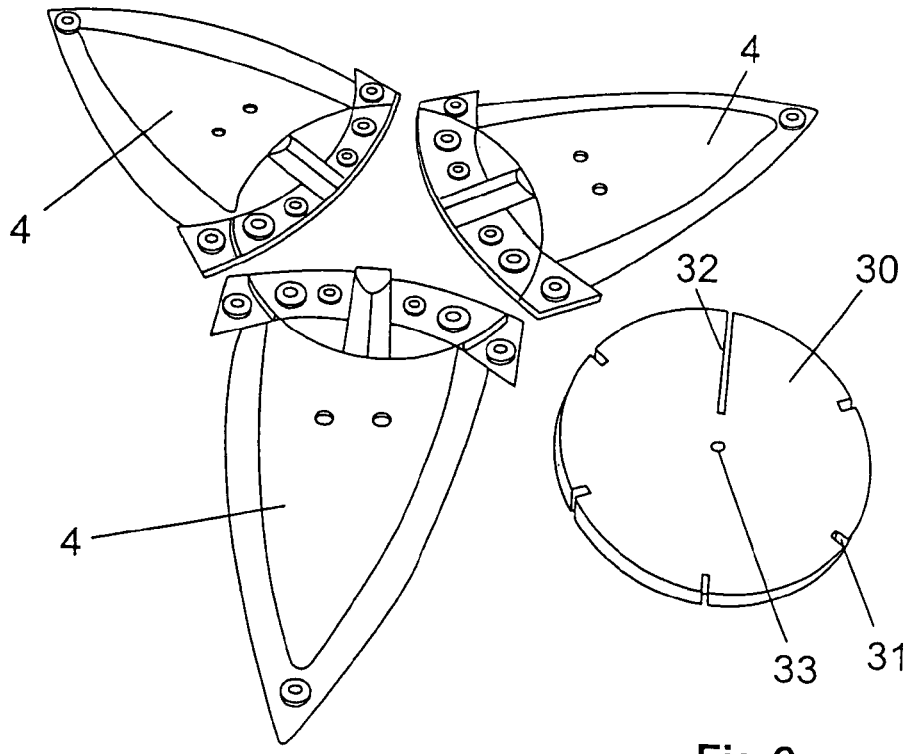
FIG. 6 shows views of the undersides of the various components of the interface adapter of FIG. 3.

FIG. 6 shows the underside of the interface adapter of FIG. 3. Here it is possible to see in particular the four different main elements of the interface adapter, namely the circular connecting element 30 and the three guide elements 4.

Figure 7:
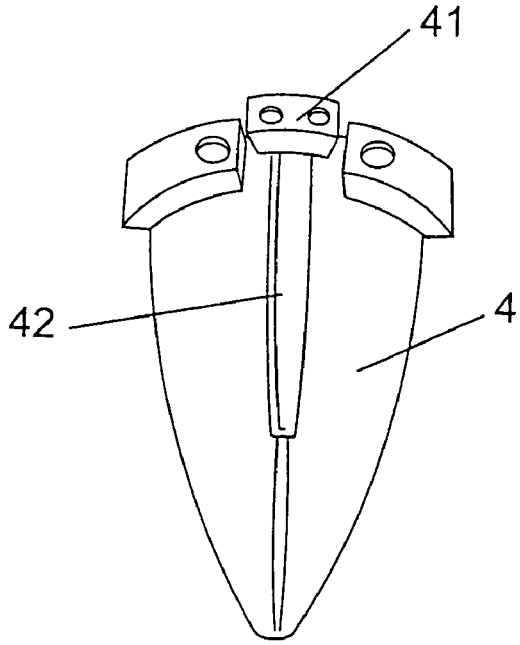
FIGS. 7 and 8 show views of guide elements of the interface adapter of FIG. 3.

FIG. 7 shows a guide element 4. A microphone is fitted into the groove 42 of the guide element 4 and fixed to the guide element 4 with a clamp 41.

Figure 8:
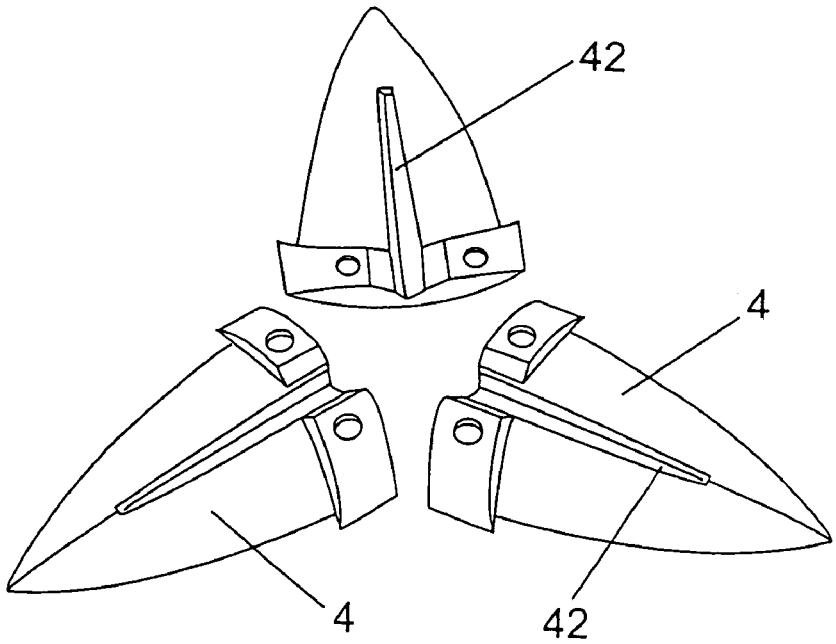

FIG. 8 shows three guide elements 4 each having a groove 42 for receiving a microphone.

Figure 9:
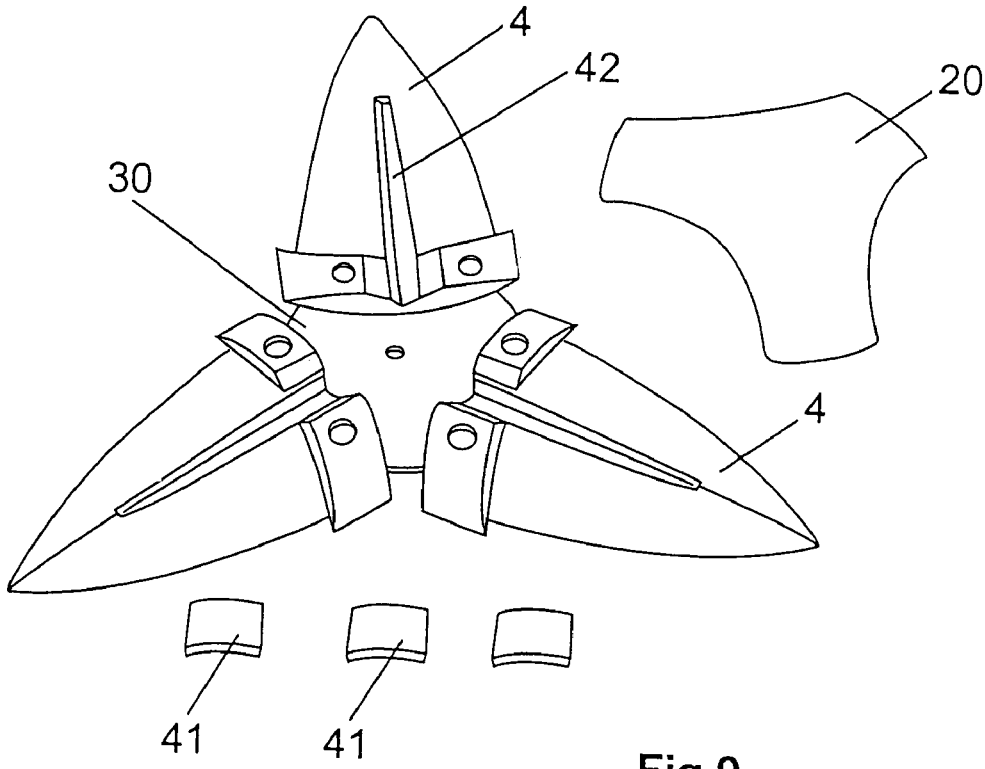
FIG. 9 shows views of all component parts of the interface adapter of FIG. 3.

FIG. 9 shows all component parts required for the interface adapter in accordance with the second embodiment. The interface adapter thus comprises three guide elements 4, a connecting element 30, a cover element 20 and three clamps 41. The three guide elements 4 are fixed to the connecting element 30. The microphones 100 can then be fitted into the grooves 42 in the guide elements 4 and fixed with the respective clamps 41. Finally the cover element 20 is placed over the guide elements 4 and fixed to the connecting element 30 preferably with a screw connection.

Figure 10:
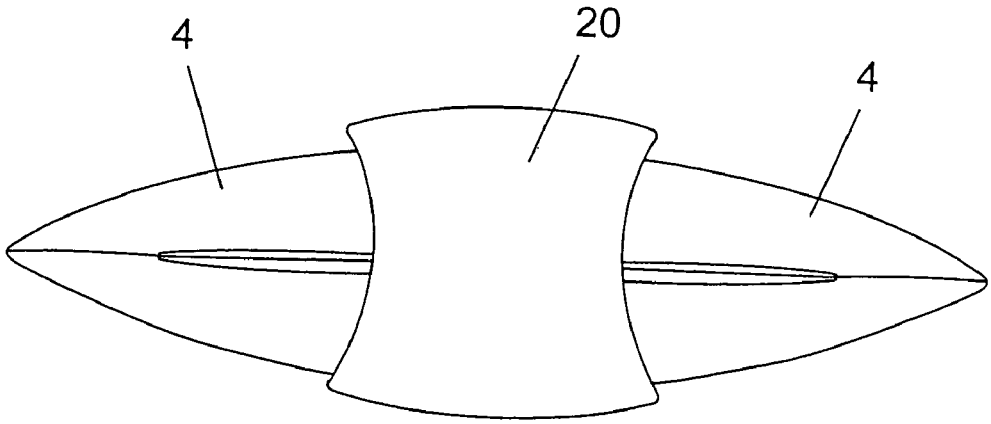
FIG. 10 shows a perspective view of an interface adapter in accordance with a third embodiment.

FIG. 10 shows an interface adapter in accordance with a third embodiment. The interface adapter in accordance with the third embodiment is based on the individual elements of the interface adapter of the second embodiment. In particular the guide elements 4 are identical to the guide elements of the second embodiment. Only a connecting element 30 and a cover element 20 have to be adapted in respect of their structure in such a way that only two guide elements 4 are received.

Accordingly, based on the component parts of the interface adapter in accordance with the second embodiment, it is possible to provide an interface adapter having two, three, four, five etc guide elements. The geometrical configuration of the guide elements 4 can be of any desired nature as long as it is ensured that a microphone 100 can be disposed in a groove-shaped recess 42.

By virtue of the above-described modular system in accordance with the second embodiment it is thus possible to assemble as desired an interface adapter of the required geometry.

While the foregoing description and drawings represent the present invention, it will be obvious to those skilled in the art that various changes may be made therein without departing from the true spirit and scope of the present invention.

The invention claimed is:

1. A boundary layer adapter for receiving a directional microphone comprising:

a receiving unit having a hole for receiving the directional microphone, said receiving unit being adapted to be placed on a boundary layer; and at least one arresting unit for arresting the received directional microphone;

wherein the hole is arranged to receive the directional microphone such that a longitudinal direction of the directional microphone is substantially parallel to the boundary layer.

2. The boundary layer adapter as set forth in claim 1, further comprising:

an elongate guide unit for guiding the received directional microphone.

3. The boundary layer adapter as set forth in claim 1, further comprising:

means for solid-conducted sound decoupling.

4. The boundary layer adapter as set forth in claim 2, further comprising:

means for solid-conducted sound decoupling.

5. The boundary layer adapter as set forth in claim 3;

wherein the means for solid-conducted sound decoupling are in the form of rubber rings.

6. The boundary layer adapter as set forth in claim 4;

wherein the means for solid-conducted sound decoupling are in the form of rubber rings.

7. The boundary layer adapter as set forth in claim 1, further comprising:

a buffer in the hole for receiving the directional microphone.

8. A boundary layer adapter for receiving a directional microphone comprising:

at least one guide element for receiving the directional microphone, said guide element being adapted to be placed on a boundary layer;

at least one arresting unit for arresting the received directional microphone; and a connecting element for connecting the guide elements;

wherein the at least one guide element is adapted to receive the directional microphone such that a longitudinal direction of the directional microphone is substantially parallel to the boundary layer.

9. The boundary layer adapter as set forth in claim 8;

wherein the guide element has a groove-shaped recess for receiving the directional microphone.

10. The boundary layer adaptor as set forth in claim 1;

wherein the interface adaptor fixes directional microphone on an boundary layer, in particular a flat boundary layer.

* * * * *